United States Patent [19]

Günther et al.

[11] 4,169,810

[45] Oct. 2, 1979

[54] MIXTURES OF OPTICAL BRIGHTENERS

[75] Inventors: Dieter Günther, Kelkheim; Rüdiger Erckel, Hofheim; Günter Rösch, Bad Soden; Heinz Probst, Sulzbach, all of Fed. Rep. of Germany

[73] Assignee: Hoechst Aktiengesellschaft, Frankfurt am Main, Fed. Rep. of Germany

[21] Appl. No.: 903,606

[22] Filed: May 8, 1978

[30] Foreign Application Priority Data

May 11, 1977 [DE] Fed. Rep. of Germany ..... 2721084

[51] Int. Cl.[2] ..... C09K 11/06; C11D 7/26; D06L 3/12

[52] U.S. Cl. ..... 252/301.24; 8/1 W

[58] Field of Search ..... 252/301.24, 301.22; 8/1 W

[56] References Cited

U.S. PATENT DOCUMENTS

| | | | |
|---|---|---|---|
| 3,595,801 | 7/1971 | Rosch et al. | 252/301.24 |
| 3,711,474 | 1/1973 | Lyness et al. | 252/301.24 X |
| 4,105,399 | 8/1978 | Luthi | 8/1 W |
| 4,129,412 | 12/1978 | Gunther et al. | 8/1 W |

FOREIGN PATENT DOCUMENTS

| | | | |
|---|---|---|---|
| 1378454 | 10/1964 | France | 252/301.24 |
| 50-102621 | 8/1975 | Japan | 252/301.24 |

*Primary Examiner*—F. C. Edmundson
*Attorney, Agent, or Firm*—Connolly and Hutz

[57] ABSTRACT

A mixture of optical brighteners containing 0.05 to 0.95 part by weight of a compound from the benzoxazolyl- or benzothiazolylstilbene series and 0.95 to 0.05 part by weight of a compound of the bis-benzoxazolyl- or bis-benzothiazolylstilbene series or of the benzoxazolyl- or benzothiazolyl-stilbene oxazolo[5,4-6]pyridinyl or oxazolo[2,3-b]pyridinyl series. These mixtures show an enhanced degree of whiteness as compared to the same amount of the single components.

4 Claims, No Drawings

MIXTURES OF OPTICAL BRIGHTENERS

Subject of the present invention are mixtures of optical brighteners consisting of from 0.05 to 0.95 part by weight of a compound of the formula I

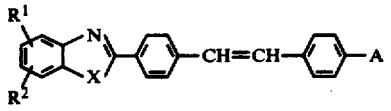

I and from 0.95 to 0.05 part by weight of a compound of the formulae II or III

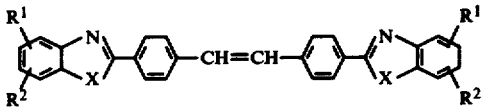

II

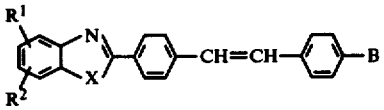

III

In the above formulae I, II and III, the symbols X, $R^1$, $R^2$, A and B have the following meanings:

X is an oxygen or sulfur atom, $R^1$ and $R^2$ independently from each other, are identical or different radicals selected from the group of hydrogen, fluorine or chlorine atoms, phenyl, $C_1$-$C_9$-alkyl, $C_1$-$C_4$-alkoxy, $C_1$-$C_4$-dialkylamino, acylamino radicals, or optionally functionally modified carboxy or sulfo groups, two adjacent radicals $R^1$ and $R^2$ together optionally representing a benzo ring, a lower alkylene or a 1,3-dioxa-propylene group, A is cyano, a group of the formulae —$COOR^3$ or —$CONR_2^3$, in which $R^3$ is hydrogen, alkenyl, $C_1$-$C_{18}$-alkyl, cycloalkyl, aryl, alkylaryl, halogenoaryl, aralkyl, alkoxyalkyl, halogenoalkyl, hydroxy-alkyl, alkylamino-alkyl, carboxyalkyl or carboalkoxyalkyl, or two alkyl or alkenyl radicals having the meaning of $R^3$, together with the nitrogen atom, may form a morpholine, piperidine or piperazine ring; or A is a group of the formulae

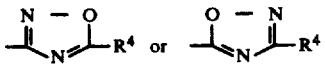

in which $R^4$ is a linear or branched alkyl group having from 1 to 18 carbon atoms, preferably 1 to 6 carbon atoms, optionally substituted by hydroxy groups, halogen atoms, lower alkoxy, dialkylamino, lower alkylmercapto, chloro-aryloxy, aryloxy, arylmercapto or aryl radicals; in the case of the dialkylamino-alkyl groups the two alkyl groups optionally forming together a morpholine, piperidine or piperazine ring; or $R^4$ is a group of the formula —$(CH_2CH_2O)_n$—R, in which n is 1, 2 or 3 and R is H, lower alkyl, dialkylamino-alkoxyalkyl or alkylthio-alkoxyalkyl, the alkyl groups in the dialkylamino-alkoxyalkyl optionally forming together a piperidine, pyrrolidine, hexamethyleneimine, morpholine, or piperazine ring; or $R^4$ is a group of the formula —$(CH_2)_m$—CH=CH—R (m is an integer of from 0 to 5), or a radical of the formula:

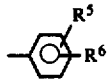

in which $R^5$ and $R^6$, being identical or different, each are radicals selected from the group of hydrogen, fluorine or chlorine atoms, phenyl, lower alkyl, lower alkoxy, ($C_1$-$C_4$)-acylamino groups, or optionally modified carboxy or sulfo groups; two adjacent radicals $R^5$ and $R^6$ together optionally being a lower alkylene group, a fused benzo ring or a 1,3-dioxapropylene group; and B is a group of the formulae

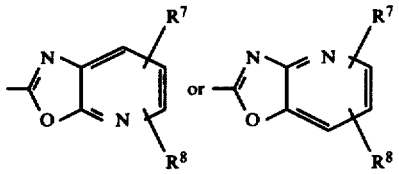

in which $R^7$ and $R^8$, independently from each other, are hydrogen, fluorine or chlorine atoms or $C_1$-$C_4$ alkyl groups.

Especially interesting are those compounds of the formula I, wherein X, A, $R^1$ and $R^2$ are as defined above and $R^4$ represents the following groups: ($C_1$-$C_6$)-alkyl, ($C_1$-$C_6$)-chloroalkyl, dimethyl- or diethylamino ($C_1$-$C_4$) alkyl, morpholinoethyl, N-β-piperidinoethyl, N-β-(N'-methylpiperazino)ethyl, benzyl, phenoxy-($C_1$-$C_4$)alkyl, chlorophenoxy-($C_1$-$C_4$)alkyl, ($C_1$-$C_4$)alkylmercapto-($C_1$-$C_4$)alkyl, phenylmercapto-($C_1$-$C_4$)alkyl, phenyl, ($C_1$-$C_6$)alkylphenyl, di-($C_1$-$C_6$)alkylphenyl, chlorophenyl, dichlorophenyl, ($C_1$-$C_6$)alkoxyphenyl, or β-naphthyl or a group of the formula —$(CH_2$—$CH_2O)_n$—R, in which n is 1, 2 or 3, and R is a hydrogen atom, a ($C_1$-$C_7$)alkyl group, a ($C_1$-$C_4$)alkylmercapto-($C_1$-$C_4$)alkyl, dimethyl- or diethylamino-($C_1$-$C_4$)alkyl or a morpholino-($C_1$-$C_4$)alkyl group.

Preferred are alternatively those compounds of the formula I, wherein X is O or S, $R^1$ and $R^2$, independently from each other, are hydrogen or chlorine atoms in 5-, 6- or 7-position, ($C_1$-$C_4$)-alkyl, phenyl or, together, a fused benzo ring, and $R^4$ in the A group is ($C_1$-$C_6$)alkyl, ($C_1$-$C_6$)-chloroalkyl, ($C_1$-$C_4$) alkoxy-($C_1$-$C_4$)alkyl, hydroxy ($C_1$-$C_4$)alkyl or a group of the formula —$(CH_2CH_2O)_n$—R', in which n is 2 or 3 and R' is hydrogen or ($C_1$-$C_4$)alkyl.

A further especially interesting subgroup comprises those compounds of the formula I, in which X is an oxygen atom, $R^1$ in 5-position is a hydrogen or chlorine atom, a methyl or phenyl group, $R^2$ is a hydrogen atom, or $R^1$ and $R^2$ form together a methyl group in 5,6- or 5,7-position, and $R^4$ in the A group represents a methyl-, ethyl-, n- or i-propyl, n- or i-butyl, pentyl, chloromethyl, β-chloroethyl, β-hydroxyethyl, β-methoxyethyl, β-ethoxyethyl, benzyl, phenyl, o-tolyl, p-tolyl, 2,4-dimethylphenyl, o-chlorophenyl, p-chlorophenyl, 2,4-dichlorophenyl or p-methoxy-phenyl group.

Preferred compounds of the formula II are those in which $R^1$ and $R^2$ in 5-, 6- or 7-position are hydrogen or chlorine atoms, ($C_1$-$C_4$)alkyl, phenyl or together form a fused benzo ring, and especially those compounds where $R^1$ in 5-position is a hydrogen or chlorine atom, a mthyl or phenyl group, $R^2$ is a hydrogen atom, or both $R^1$ and $R^2$ represent a methyl group in 5,6- or 5,7 position.

Preferred compounds of the formula III are those wherein $R^1$ and $R^2$ in 5-, 6- or 7-position are hydrogen or chlorine atoms, ($C_1$-$C_4$)alkyl, phenyl, or form together a fused benzo ring, and $R^7$ and $R^8$, independently from each other, represent hydrogen or methyl. Especially interesting are compounds of the formula III, in which $R^1$ and $R^2$ are hydrogen, chlorine or methyl, and $R^7$ and $R^8$ are hydrogen or methyl.

By functionally modified carboxy groups there are to be understood generally carboxylic acid derivatives in every respect, that is, compounds having one carbon atoms which is linked to three hetero atoms, especially oxygen, nitrogen and sulfur. In a more limited sense, there are to be understood salts with colorless cations, alkali metal or ammonium ions being preferred, and furthermore a cyano, carboxylic acid ester or carboxylic acid amide group. By carboxylic acid ester groups, there are to be understood especially those of the formula $COOQ^1$, in which $Q^1$ is a phenyl radical or an optionally branched lower alkyl group. By carboxylic acid amide group, there is to be understood especially a group of the formula $CONQ^2Q^3$, in which $Q^2$ and $Q^3$ are hydrogen atoms or optionally substituted lower alkyl groups which may form a hydroaromatic ring together with the nitrogen atom.

By functionally modified sulfo groups, there are to be understood, in analogy to the above details, radicals the sulfo group of which is linked to a hetero atom, that is, salts with colorless cations, preferably alkali metal or ammonium ions, and furthermore sulfonic acid ester groups and the sulfonamide group. By sulfonic acid ester group, there is to be understood especially a group of the formula $SO_2OQ^1$, in which $Q^1$ is as defined above, and by sulfonamide group, there is to be understood a group of the formula $SO_2NQ^2Q^3$, in which $Q^2$ and $Q^3$ are as defined above.

By acyl group, there is to be understood especially a group of the formula $COQ^4$, in which $Q^4$ is an optionally substituted, preferably lower, alkyl radical, or a phenyl radical, especially an unsubstituted $C_1$-$C_4$alkanoyl group or the benzoyl group. Preferred substituents $R^3$ are $C_1$-$C_6$ alkyl, halogeno-alkyl or alkoxy.

Apart from the above subgroups, any further subgroups may be formed using the individual meanings of the symbols X, $R^1$, $R^2$, A and B. Of course, formation of such subgroups does not mean that introduction of new matter according to 35 U.S.C. 132 is intended. Unless otherwise defined, alkyl groups and derivatives thereof contain each from 1 to 4 carbon atoms.

In detail, the following radicals may be cited as examples of $R^1$ and $R^2$: methyl, ethyl, n- or i-propyl, n- or i-butyl, pentyl, hexyl, methoxy, ethoxy, propoxy, butoxy, pentoxy, hexoxy, dimethylamino, diethylamino, trimethylammonium, triethylammonium, acetylamino, cyano- —$SO_3H$, carboxyl, carbo-methoxy, -ethoxy, -propoxy, -butoxy and the corresponding groups in the series of sulfonic acid alkyl ester groups, methyl, ethyl, propyl and butyl-carbonamide and the corresponding groups in the series of alkylsulfonamides, and the corresponding dialkylcarbonamide and -sulfonamide groups. Two adjacent groups $R^1$ and $R^2$ may form together a fused phenyl or cyclohexyl ring. For X, all thosee compounds are preferred which contain the benzoxazolyl group (X=O).

$R^4$ may comprise for example the following groups: methyl, ethyl, n- or i-propyl, n- or i-butyl, pentyl, hexyl, or the chloroalkyl, hydroxyalkyl, dimethylaminoalkyl, diethylaminoalkyl, methoxyalkyl, ethoxyalkyl, propoxyalkyl, butoxyalkyl, methylmercaptoalkyl, ethylmercaptoalkyl, chlorophenoxyalkyl, phenoxyalkyl, phenylmercaptoalkyl, phenylalkyl, or naphthylalkyl groups derived therefrom; furthermore groups of the formula $—(CH_2CH_2O)_n—R$, in which n is 1, 2 or 3, and R a hydrogen atom, a methyl, ethyl, propyl, or butyl group, a dimethyl or diethylamino-alkoxyalkyl group having from 1 to 4 carbon atoms in the alkyl or alkoxy moiety, or such alkylthio-alkoxyalkyl groups containing also from 1 to 4 carbon atoms per individual alkyl or alkoxy moiety. Examples are the radicals of the following formulae:

$—CH_2CH_2OCH_3$, $—CH_2CH_2OC_2H_5$, $—CH_2CH_2OC_3H_7$,
$—CH_2CH_2OC_4H_9$, $—CH_2CH_2OC_6H_{13}$,

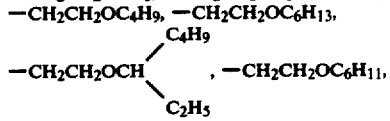

$—CH_2CH_2OCH(C_4H_9)(C_2H_5)$, $—CH_2CH_2OC_6H_{11}$,
$—(CH_2CH_2O)_2CH_3$, $—(CH_2CH_2O)_2C_2H_5$,
$—(CH_2CH_2O)_2C_4H_9$, $—(CH_2CH_2O)_3C_2H_5$,
$—CH_2CH_2OCH_2CH_2SC_2H_5$,
$—CH_2CH_2OCH_2CH_2—N(CH_2)_2$,
$—CH_2CH_2OCH_2CH_2—N(C_2H_5)_2$ or

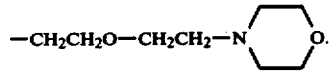

$R^4$ may also stand for an unsubstituted or a mono- or bisubstituted phenyl group, the alkyl, alkoxy, acyl, carbalkoxy, alkylcarbonamido, alkylsulfonamido and sulfonic acid alkyl ester groups optionally containing each from 1 to 4 carbon atoms. Two substituents $R^5$ and $R^6$ may together form a fused benzo or cyclohexyl ring.

The compounds of the formula I, as far as they do not contain an oxadiazole ring, are described in the following Japanese Patent Applications: Sho 43-7045; Sho 44-6979; Sho 44-6980; Sho 44-6981, Sho 44-6982 and Sho 42-21013.

The compounds of the formula I, in which A is an oxadiazole ring, may be prepared according to German Offenlegungsschrift No. 27 09 924 by reacting a compound of the formula IV

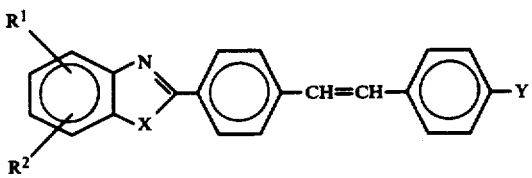

IV with a compound of the formula V $R^4—Z$ V in which formulae $R^1$, $R^2$ and $R^4$ are as defined above, and Y is a group of the formula VI

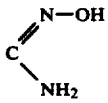

VI

Z representing simultaneously a group of the formula VII

—COCl VII or Y is a group of the formula VII and Z is simultaneously a group of the formula VI.

In the first case, compounds of the formula I are obtained which contain a 1,2,4-dioxazolyl-3 group, and in the second case, the compounds contain the 1,2,4-dioxazolyl-5 group. The reaction is carried out preferably in the presence of an acid-binding agent in an inert solvent at temperatures of from 20° to 200° C.

The starting compounds of the formula V, in which Z is a group of the formula VI can be prepared according to the process described in Chem. Rev. 62 (1962), p. 155 et sequ. According to this process, the starting compounds of the formula IV, in which Y is a group of the formula VI, may be obtained in analogous manner.

The compounds of the formula II are known from the following Patent Specifications: German Auslegeschriften Nos. 1 255 077; 1 288 608; 1 445 694; German Offenlegungsschrift No. 1 469 207, and Belgian Pat. No. 648 674.

The compounds of the formula III are obtained according to known processes by reaction of a carboxylic acid of the formula

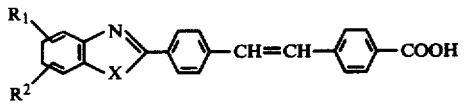

or the acid chloride thereof with a compound of the formula

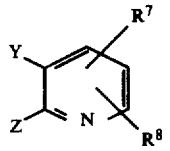

in which formulae $R^1$, $R^2$, $R^7$, $R^8$ and Z are as defined above, and either Z is an amino group and Y a hydroxy group or Y is an amino group and Z a hydroxy group or a chlorine atom. This reaction is carried out at elevated temperatures, for example from 120° to 330° C., with or without intermediate isolation of the acyl compound obtained in the first place, and preferably in the presence of acidic catalysts such as zinc chloride or polyphosphoric acid. Optionally, the reaction may be carried out alternatively in a high-boiling inert organic solvent (German Offenlegungsschrift No. 2 712 942).

The reaction products of the above processes may be subjected to known further conversions, for example those which, starting from sulfo or carboxy group containing molecules, yield compounds having functionally modified sulfo or carboxy groups, and conversions of such groups to other groups of this kind, or to the free acids. Furthermore, chloromethyl groups may be introduced or methyl groups may be oxidized. Halogenation and further reactions of the halogen atoms introduced may likewise be carried out, for example chlorine or bromine may be replaced by the amine function.

The mixing ratio of the individual components is from 0.05 to 0.95 part by weight of component I to the corresponding amount (0.95 to 0.05 part by weight) of the mixture of compounds II and III.

Preferred is a mixing ratio of from 0.05 to 0.95 part by weight of compound I and the corresponding amount necessary to complete 1 part by weight of components II and III together. The optimum mixing ratio depends in each case on the kind of the compounds of formulae I, II and III, respectively, and it can be easily determined by simple preliminary tests. The ratio of compounds II and III to each other is not critical at all and may vary within the range of from 0 to 1 part by weight; that is, one of the compounds II or III alone may alternatively be mixed with compound I in the above quantitative range.

As usual in the case of optical brighteners, the individual components are given a commercial application form by dispersing them in a solvent. The components may be dispersed individually and the corresponding dispersions may then be united, or the components may be mixed in substance and then be dispersed together. Dispersion is carried out as usual in ball mills, colloid mills, bead mills or dispersion kneaders.

The mixtures of the invention are especially suitable for the optical brightening of textile materials of linear polyesters, polyamides or acetyl cellulose. Alternatively, these mixtures can also be used with good results for blended fabrics of linear polyesters and other synthetic or natural fiber materials, above all hydroxy group containing fibers, especially cotton. The brightener mixtures are applied under the usual conditions, for example according to the exhaust process at 90° to 130° C., with or without addition of carriers, or according to the thermosol process. The optical brighteners insoluble in water and the mixtures of the invention may alternatively be applied in the form of solutions in organic solvents, for example perchloroethylene or fluorinated hydrocarbons. In this latter case, the textile material can be treated with the solvent liquor containing the dissolved optical brightener according to the thermosol process, or it is impregnated, face-padded, or sprayed with the solvent liquor containing the brightener, and subsequently dried at temperatures of from 120° to 220° C., thus obtaining a complete fixation of the optical brightener in the fiber.

The advantage of these mixtures as compared to the individual components resides in the fact that they allow to achieve an unexpected synergistic effect as to the degree of whiteness; that is, a mixture of compounds of the formula I, II and/or III yields a higher degree of whiteness than the same amount of only one compound of the formulae I, II or III, and this is valid also for the brilliancy of the brightenings. Furthermore, the brightenings obtained with the use of the mixtures of the invention have a violet-bluish shade which is generally more agreeable to the human eye than the somewhat reddish brightenings obtained with the use of the compounds of the formula I per se or the greenish brightenings resulting when employing the compounds of the formulae II or III alone.

The following Examples illustrate the invention; parts and percentages being by weight and the temperatures being indicated in centigrades. The degree of whiteness is measured according to the formulae of Stensby (Soap and Chemical Specialities, April 1967, p. 41 ft) and Berger (Die Farbe, 8 (1959), p. 187 et sequ.).

EXAMPLE 1

A fabric of polyester filaments was washed and rinsed in usual manner in a jig, and dried at 120° C. The material so pretreated was subsequently impregnated with a solution containing 0.8 g/l each of an optical brightener of the formula I, or the formula II, or 0.8 g/l of a mixture of both brighteners.

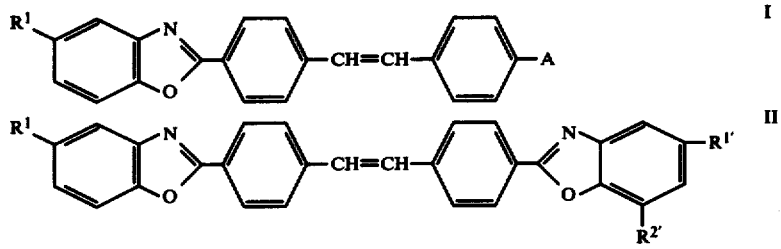

I

II

The material so impregnated was then squeezed off between rollers and adjusted to a moisture content of 80%, subsquently dried on a stenter for 20 seconds at 120° C. and thermosolated for 30 seconds at 190° C. The degree of whiteness indicated in the following Table 1 were measured:

The Table shows that higher degrees of whiteness than in the case of the individual component are obtained when the mixtures are used.

EXAMPLE 2

Sections of knitted fabric of textured polyester filaments were pre-washed as usual and subsequently brightened for 30 minutes at 120° C. in a dyeing apparatus (jet) under high-temperature conditions. The liquors contained each 0.08% of the textile weight of optical brighteners corresponding to the formulae I or II. For a comparison, the brighteners were used per se and in the mixing ratios as indicated in the following Table 2.

Table 1

| | Brightener formula (I) | | Brightener Formula (II) | | | | Degrees of whiteness | |
|---|---|---|---|---|---|---|---|---|
| A | $R^1$ | concentration | $R^1$ | $R^{1'}$ | $R^{2'}$ | concentraion | Berger | Stensby |
| $COOCH_3$ | $CH_3$ | 0.8 g/l | | | | | 148 | 151 |
| $COOCH_3$ | H | " | | | | | 143 | 147 |
| COOH | H | " | | | | | 124 | 128 |
| 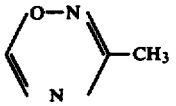 | H | " | | | | | 155 | 157 |
| 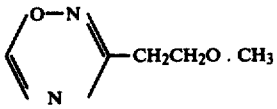 | H | " | | | | | 148 | 149 |
| 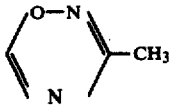 | $CH_3$ | " | H | $CH_3$ | H | 0.8 g/l | 160 | 154 |
| | | | $CH_3$ | $CH_3$ | H | " | 161 | 154 |
| | | | H | $CH_3$ | $CH_3$ | " | 160 | 152 |
| | | | $CH_3$ | $CH_3$ | $CH_3$ | " | 156 | 147 |
| | | | H | $C_9H_{19}$ | H | " | 149 | 144 |
| | | | H | H | H | " | 159 | 154 |
| $COOCH_3$ | $CH_3$ | 0.6 g/l | H | $CH_3$ | H | 0.2 g/l | 162 | 158 |
| " | " | 0.72 g/l | $CH_3$ | $CH_3$ | $CH_3$ | 0.08 g/l | 156 | 154 |
| " | H | 0.64 g/l | $CH_3$ | $CH_3$ | H | 0.16 g/l | 161 | 157 |
| " | H | 0.68 g/l | H | $C_9H_{19}$ | H | 0.12 g/l | 151 | 153 |
| COOH | H | 0.56 g/l | H | $CH_3$ | $CH_3$ | 0.24 g/l | 155 | 150 |
| 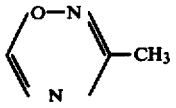 | H | 0.76 g/l | H | $CH_3$ | H | 0.04 g/l | 160 | 160 |
| 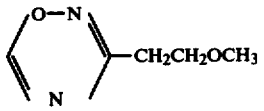 | H | 0.74 g/l | H | $CH_3$ | $CH_3$ | 0.06 g/l | 154 | 153 |
| 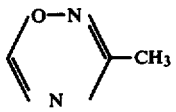 | $CH_3$ | 0.75 g/l | H | H | H | 0.05 g/l | 160 | 157 |

After rinsing and drying, the degrees of whiteness as indicated in the Table 2 were measured.

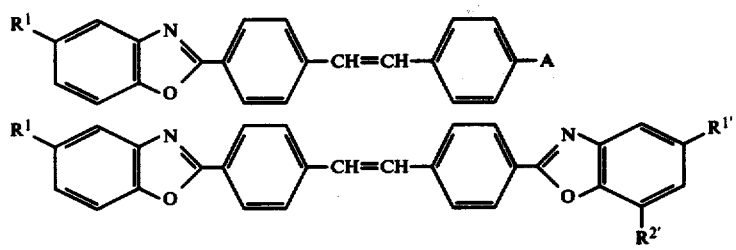

I

II

Table 2

| Brightener formula (I) | | | Brightener formula (II) | | | | Degrees of whiteness | |
|---|---|---|---|---|---|---|---|---|
| A | $R^1$ | concentration | $R^1$ | $R^{1'}$ | $R^{2'}$ | concentration | Berger | Stensby |
| $COOCH_3$ | $CH_3$ | 0.08 % | | | | | 148 | 152 |
| $COOCH_3$ | H | " | | | | | 145 | 149 |
| COOH | H | " | | | | | 124 | 128 |
| 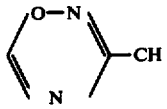 | H | " | | | | | 160 | 158 |
| 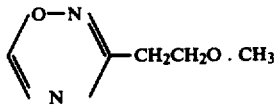 | H | " | | | | | 156 | 155 |
| 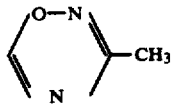 | $CH_3$ | " | | | | | 160 | 156 |
| | | | H | $CH_2$ | H | 0.08 % | 157 | 151 |
| | | | $CH_3$ | $CH_3$ | H | " | 151 | 140 |
| | | | H | $CH_3$ | $CH_3$ | " | 156 | 149 |
| | | | $CH_3$ | $CH_3$ | $CH_3$ | " | 155 | 146 |
| | | | H | $C_9H_{19}$ | H | " | 148 | 144 |
| | | | H | H | H | " | 147 | 146 |
| $COOCH_3$ | $CH_3$ | 0.06 % | H | $CH_3$ | H | 0.02 % | 161 | 158 |
| $COOCH_3$ | H | 0.064 % | $CH_3$ | $CH_3$ | H | 0.016 % | 157 | 156 |
| COOH | H | 0.056 % | H | $CH_3$ | $CH_3$ | 0.024 % | 160 | 156 |
| $COOCH_3$ | $CH_3$ | 0.072 % | $CH_3$ | $CH_3$ | $CH_3$ | 0.008 % | 157 | 155 |
| $COOCH_3$ | H | 0.068 % | H | $C_9H_{19}$ | H | 0.012 % | 152 | 154 |
| $COOCH_3$ | $CH_3$ | 0.06 % | H | H | H | 0.02 % | 156 | 157 |
| 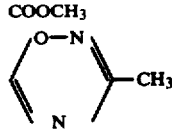 | | 0.076 % | H | $CH_3$ | H | 0.004 % | 162 | 158 |
| 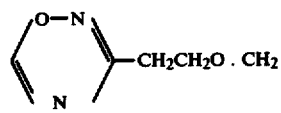 | | 0.074 % | H | $CH_3$ | $CH_3$ | 0.006 % | 161 | 156 |
| 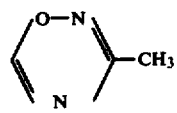 | | 0.072 % | H | H | H | 0.008 % | 163 | 157 |

These Examples, too, prove that the mixtures are superior to the corresponding individual components as to the degree of whiteness.

EXAMPLE 3

Polyester curtains in raschel-tulle weave were prewashed as usual in a continuous washing machine, dried at 120° C. on a stenter and wound up on a dyeing beam. After having been introduced into a high-temperature dyeing apparatus, the material was treated with liquors containing each a total of 0.05% (of the textile weight) of optical brighteners of the formulae indicated in Examples 1 and 2 alone or in the mixing ratios as indicated in Table 3, furthermore 3 g/l of 50% sodium chlorite. The pH of the liquors was adjusted to 4 by means of formic acid. The curtains were bleached or brightened for 45 minutes each at 120° C., subsequently rinsed, dried and thermofixed at 180° C. The degrees of whiteness as indicated in Table 3 were obtained.

Table 3:

| Brightener formula (I) | | | Brightener formula (II) | | | | Degrees of whiteness | |
|---|---|---|---|---|---|---|---|---|
| A | $R^1$ | concentration | $R^1$ | $R^{1'}$ | $R^{2'}$ | concentration | Berger | Stensby |
| $COOCH_3$ | $CH_3$ | 0.05 % | | | | | 146 | 150 |
| $COOCH_3$ | H | 0.05 % | | | | | 143 | 148 |
| COOH | H | 0.05 % | | | | | 140 | 145 |
| | | | H | $CH_3$ | H | 0.05 % | 159 | 152 |
| | | | $CH_3$ | $CH_3$ | H | " | 147 | 139 |
| | | | H | $CH_3$ | $CH_3$ | " | 156 | 150 |
| | | | $CH_3$ | $CH_3$ | $CH_3$ | " | 154 | 145 |
| | | | H | $C_9H_{19}$ | H | " | 147 | 142 |
| | | | H | H | H | " | 130 | 121 |
| $COOCH_3$ | $CH_3$ | 0.0375 % | H | $CH_3$ | H | 0.0125 % | 160 | 156 |
| $COOCH_3$ | H | 0.04 % | $CH_3$ | $CH_3$ | H | 0.01 % | 158 | 153 |
| COOH | H | 0.0425 % | H | $CH_3$ | $CH_3$ | 0.075 % | 157 | 152 |
| $COOCH_3$ | $CH_3$ | 0.025 % | $CH_3$ | $CH_3$ | $CH_3$ | 0.025 % | 157 | 152 |

The degrees of whiteness of the curtain sections treated with the brightener mixtures are clearly superior to those of the individual components.

EXAMPLE 4

Fabrics of polyester filaments were washed and rinsed as usual on a jig, and subsequently treated with 0.08% each of optical brighteners corresponding to the formulae I and II. For a comparison, the brighteners were applied per se and as mixtures.

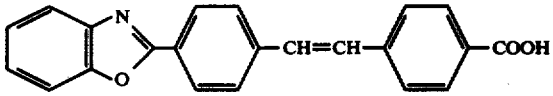

(I)

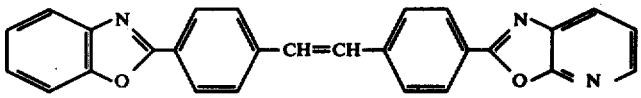

(II)

The polyester fabric was treated for 60 minutes at boiling temperature with addition of a commercial dyeing accelerator on the basis of diphenyl in a goods-to-liquor ratio of 1:6, rinsed and dried at 120° C. The degrees of whiteness as indicated in Table 4 were obtained:

| Brightener formula (I) % | Brightener formula (II) % | Degree of whiteness Berger | Stensby |
|---|---|---|---|
| 0.08 | — | 139 | 145 |
| — | 0.08 | 156 | 147 |
| 0.06 | 0.02 | 159 | 156 |

Also in this case, the mixture yields a clearly higher degree of whiteness than the individual component.

EXAMPLE 5

Sections of fabrics of polyester staple fiber were washed and dried as usual, and impregnated on a foulard with solutions containing 0.8 g/l of an optical brightener of the formula I

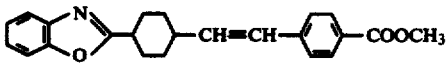

I and an optical brightener of the formula II

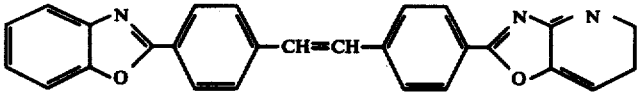

II

The material so padded was subsequently dried on a stenter for 30 seconds at 120° C., and thermosolated at 190° C. for a further 30 seconds. The following degrees of whiteness were obtained, and again the mixtures showed a higher brilliancy than the individual components.

| Brightener formula (I) % | Brightener formula (II) % | Degree of whiteness Berger | Stensby |
|---|---|---|---|
| 0.8 | | 141 | 144 |
| | 0.8 | 154 | 146 |
| 0.72 | 0.08 | 153 | 152 |
| 0.68 | 0.12 | 157 | 155 |
| 0.64 | 0.16 | 161 | 157 |
| 0.60 | 0.20 | 161 | 156 |
| 0.56 | 0.24 | 160 | 155 |

What is claimed is:

1. Mixtures of optical brighteners consisting of from 0.05 to 0.95 part by weight of a compound of the formula I

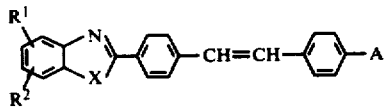

I and from 0.95 to 0.05 part by weight of a compound of the formulae II or III

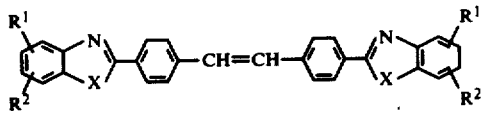

II

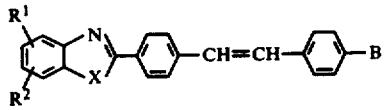

III in which formulae the symbols X, $R^1$, $R^2$, A and B have the following meanings:

X is an oxygen or sulfur atom;

$R^1$ and $R^2$ independently from each other, are identical or different radicals selected from the group of hydrogen, fluorine or chlorine atoms, phenyl, $C_1$-$C_9$-alkyl, $C_1$-$C_4$-alkoxy, $C_1$-$C_4$-dialkylamino, acylamino radicals, or optionally functionally modified carboxy or sulfo groups, two adjacent radicals $R^1$ and $R^2$ together optionally representing a benzo ring, a lower alkylene or a 1,3-dioxa-propylene group, A is cyano, a group of the formulae —$COOR^3$ or —$CONR_2{}^3$, in which $R^3$ is hydrogen, alkenyl, $C_1$-$C_{18}$-alkyl, cycloalkyl, aryl, alkylaryl, halogenoaryl, aralkyl, alkoxyalkyl, halogenoalkyl, hydroxy-alkyl, alkylamino-alkyl, carboxyalkyl or carboalkoxyalkyl, or two alkyl or alkenyl radicals having the meaning of $R^3$, together with the nitrogen atom, may form a morpholine, piperidine or piperazine ring; or A is a group of the formulae

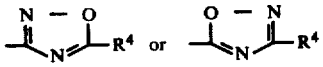

in which $R^4$ is a linear or branched alkyl group having from 1 to 18 carbon atoms, preferably 1 to 6 carbon atoms, optionally substituted by hydroxy groups, halogen atoms, lower alkoxy, dialkylamino, lower alkylmercapto, chloro-aryloxy, aryloxy, arylmercapto or aryl radicals; in the case of the dialkylamino-alkyl groups the two alkyl groups optionally forming together a morholine, piperidine or piperazine ring; or $R^4$ is a group of the formula —$(CH_2CH_2O)_n$—R, in which n is 1, 2 or 3 and R is H, lower alkyl, dialkylamino-alkoxyalkyl or alkylthio-alkoxyalkyl, the alkyl groups in the dialkylamino-alkoxyalkyl optionally forming together a piperidine, pyrrolidine, hexamethyleneimine, morpholine, or piperazine ring; or $R^4$ is a group of the formula —$(CH_2)_m$—CH=CH—R (m is an integer of from 0 to 5), or a radical of the formula:

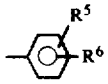

in which $R^5$ and $R^6$, being identical or different, each are radicals selected from the group of hydrogen, fluorine or chlorine atoms, phenyl, lower alkyl, lower alkoxy, ($C_1$-$C_4$)-acylamino groups, or optionally modified fied carboxy or sulfo groups; two adjacent radicals $R^5$ and $R^6$ together optionally being a lower alkylene group, a fused benzo ring or a 1,3-dioxapropylene group; and B is a group of the formulae

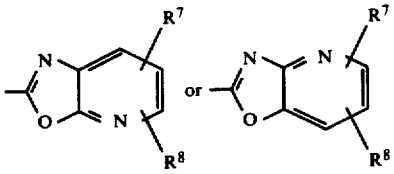

in which $R^7$ and $R^8$, independently from each other, are hydrogen, fluorine or chlorine atoms or $C_1$-$C_4$ alkyl groups.

2. Mixtures as claimed in claim 1, containing a compound of the formula I, in which X, A, $R^1$ and $R^2$ are as defined in claim 1, and $R^4$ represents the following groups: ($C_1$-$C_6$)-alkyl, ($C_1$-$C_6$)-chloroalkyl, dimethyl- or diethylamino ($C_1$-$C_4$) alkyl, morpholinoethyl, N-β-piperidinoethyl, N-β-(N'-methylpiperazino)ethyl, benzyl, phenoxy-($C_1$-$C_4$) alkyl, chlorophenoxy-($C_1$-$C_4$)alkyl, ($C_1$-$C_4$)alkylmercapto-($C_1$-$C_4$)-alkyl, phenylmercapto-($C_1$-$C_4$) alkyl, phenyl, ($C_1$-$C_6$)alkylphenyl, di-($C_1$-$C_6$)alkylphenyl, chlorophenyl, dichlorophenyl, ($C_1$-$C_6$)-alkoxyphenyl, α or β-naphthyl or a group of the formula —$(CH_2$—$CH_2O)_n$—R, in which n is 1, 2 or 3, and R is a hydrogen atom, a ($C_1$-$C_7$)alkyl group, a ($C_1$-$C_4$)alkylmercapto-($C_1$-$C_4$) alkyl, dimethyl- or diethylamino-($C_1$-$C_4$)-alkyl or a morpholino-($C_1$-$C_4$)alkyl group.

3. Mixtures as claimed in claim 1, containing a compound of the formula I wherein X is O or S, $R^1$ and $R^2$, independently from each other, are hydrogen or chlorine atoms in 5-, 6- or 7-position, ($C_1$-$C_4$)-alkyl, phenyl or, together, a fused benzo ring, and $R^4$ in the A group is ($C_1$-$C_6$)alkyl, ($C_1$-$C_6$)-chloroalkyl, ($C_1$-$C_4$) alkoxy-($C_1$-$C_4$)alkyl, hydroxy($C_1$-$C_4$)alkyl or a group of the formula —$(CH_2CH_2O)_n$—R', in which n is 2 or 3 and R' is hydrogen or ($C_1$-$C_4$)alkyl; and a compound of the formula II in which $R^1$ and $R^2$ in 5-, 6- or 7-position are hydrogen or chlorine atoms, ($C_1$-$C_4$)alkyl phenyl or together form a fused benzo ring; or a compound of the formula III wherein $R^1$ and $R^2$ in 5-, 6- or 7-position are hydrogen or chlorine atoms, ($C_1$-$C_4$)alkyl, phenyl, or form together a fused benzo ring, and $R^7$ and $R^8$, independently from each other, represent hydrogen or methyl.

4. Mixtures as claimed in claim 1, containing a compound of the formula I, in which X is an oxygen atom, $R^1$ in 5-position is a hydrogen or chlorine atom, a methyl or phenyl group, $R^2$ is a hydrogen atom, or $R^1$ and $R^2$ form together a methyl group in 5,6- or 5,7-position, and $R^4$ in the A group represents a methyl-, ethyl-, n- or i-propyl, n- or i-butyl, pentyl, chloromethyl, β-chloroethyl, β-hydroxyethyl, β-methoxyethyl, β-ethoxyethyl, benzyl, phenyl, o-tolyl, p-tolyl, 2,4-dimethylphenyl, o-chlorophenyl, p-chlorophenyl, 2,4-dichlorophenyl or p-methoxy-phenyl group; and a compound of the formula II where $R^1$ in 5-position is a hydrogen atom, or both $R^1$ and $R^2$ represent a methyl group in 5,6 or 5,7 position, or a compound of the formula III in which $R^1$ and $R^2$ are hydrogen, chlorine or methyl, and $R^7$ and $R^8$ are hydrogen or methyl.

* * * * *